United States Patent [19]

Wright

[11] Patent Number: 4,874,168

[45] Date of Patent: Oct. 17, 1989

[54] BALL CATCHING TRAINER

[75] Inventor: Robert L. Wright, Des Moines, Iowa

[73] Assignee: Creative Athletic Products and Services, Inc., Des Moines, Iowa

[21] Appl. No.: 225,888

[22] Filed: Jul. 29, 1988

[51] Int. Cl.[4] ..... A63B 71/02

[52] U.S. Cl. ..... 273/26 C; 273/67 B

[58] Field of Search ..... 273/26 R, 26 C, 67 B

[56] References Cited

U.S. PATENT DOCUMENTS

| | | | |
|---|---|---|---|
| 1,402,799 | 1/1922 | Ryan | 273/67 B |
| 1,492,343 | 4/1924 | Abrams et al. | 273/67 B |
| 2,228,586 | 1/1941 | Protzky | 273/67 B |
| 3,141,173 | 7/1964 | Jackson et al. | 273/26 R |
| 4,208,051 | 6/1980 | Robertson | 273/26 C |
| 4,387,895 | 6/1983 | Steel | 273/67 B |
| 4,516,774 | 5/1985 | Nankivell | 273/67 B |
| 4,802,669 | 2/1989 | Birmingham | 273/26 C |

*Primary Examiner*—T. Brown

*Attorney, Agent, or Firm*—Zarley, McKee, Thomte, Voorhees & Sease

[57] ABSTRACT

A strap is woven back and forth through six openings in a body member to form two pockets, one for the thumb and the second for the remaining four fingers, and the ends of the straps are secured through cooperative Velcro-type fasteners to the two strap portions forming the two pockets. The body member may be used by right- or left-handed persons by simply turning it over whereby the front-ball side for a right-hand user now becomes the rear-hand side for a left-hand user.

2 Claims, 2 Drawing Sheets

BALL CATCHING TRAINER

BACKGROUND OF THE INVENTION

A baseball or softball player can acquire a feel for the ball and improve player effectiveness at catching it through use of a rigid board-like glove during practice. The rebound characteristics of the glove require the player to move his catching hand with the ball in order to stop and hold it without it bouncing away. This will also encourage the player to use both hands in catching the ball. This feel and technique, once acquired through the use of the trainer glove, can then be carried over to use with a conventional ball glove. This will significantly improve the effectiveness of the ball player in handling balls during game situations.

Heretofore, a racquetball racquet has been employed utilizing taping around the handle strapped to the user's wrist.

A prototype of the preferred embodiment of this invention involved the trainer board being secured to the hand by a strap solely on the back side of the board secured in place by rivets or the like. A shortcoming of this trainer is that the strap would easily tear away from the body member and needs to be replaced. Also, separate trainers were required for right and left handers as a single trainer could not be used by both.

SUMMARY OF THE INVENTION

The ball catching trainer of this invention utilizes a single strap woven back and forth through openings in the body member to form two pockets on the back side with one receiving the thumb and the other receiving the remaining four fingers of the user's hand. Placement of the strap on the opposite side of the body member makes the ball catching trainer suitable for use on the other hand. Thus, the glove used for the ball catching trainer is adaptable to use by right or left handed persons. Velcro-type fasteners on the strap allow for quick fastening of the glove to the hand and removal therefrom. Adjustments are easily made to fit different sized hands by adjusting the strap around the thumb and remaining four fingers.

DESCRIPTION OF THE PREFERRED EMBODIMENT

Figure 1:
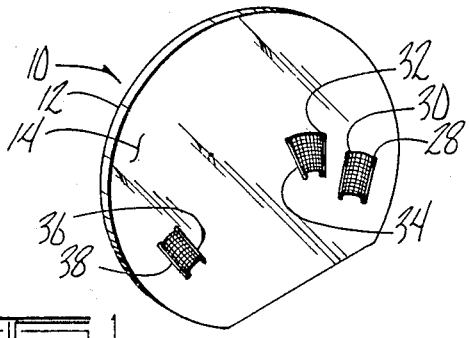
FIG. 1 is a perspective view of the front-ball side of the ball catching trainer used on a ball player's right hand.
Figure 2:
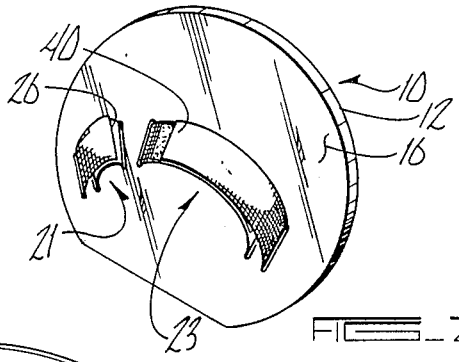
FIG. 2 is a perspective view of the rear-hand side of the ball catching trainer.

The ball catching trainer of this invention is referred to generally in FIG. 1 by the reference numeral 10 and includes a body member 12 in the form of a wood body member shaped generally the shape of a ball glove. The body member 12 has a front-ball side 14, as seen in FIG. 1, and a rear-hand side 16, as seen in FIG. 2. It is used on the user's right hand 18, as seen in FIG. 3.

A single strap 20 is woven through a series of openings in the body member 12 to form two pockets, one pocket 21 for the thumb 22 and the second pocket 23 for the remaining four fingers 24.

Figure 3:
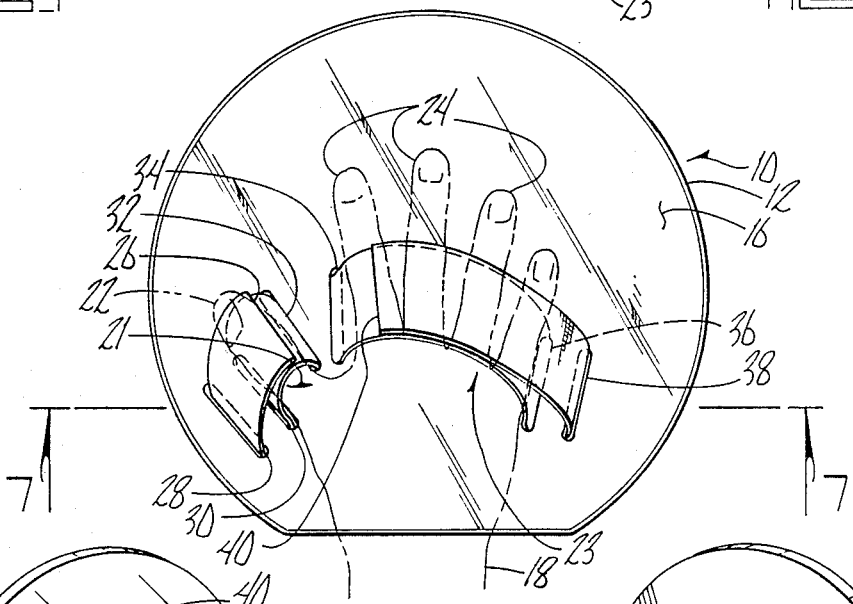
FIG. 3 is a plan view of the rear-hand side with the user's hand in the in-use position on the glove.

The strap 20 includes a first end 26 on the rear-hand side 14, as seen in FIG. 3, which extends through a first opening 28 to the front side and thence back to the rear side through an opening 30 whereupon the strap extends over the thumb 22 to form the thumb pocket 21 and back to the front side through opening 32 whereupon it returns to the rear side through opening 34 where it forms the four-finger pocket 23 upon extending back to the front side through opening 36, and lastly returns to the rear side through opening 38 where it terminates in the second or other end 40. Velcro-type hook and eye fasteners are provided on the strap ends 26 and 40 for cooperative engagement with like elements on the two pocket portions 21 and 23.

It is seen that the strap 20 may be adjustably tightened about the user's hand through use of the Velcro-type fasteners, and also the glove may be quickly and easily placed on the user's hand and removed therefrom. It is also seen that the very small portions of the strap 20 appearing on the front-ball side of the body member 12 do not intefere with use of the glove as they lie flat against the body member and cover three very small areas.

Figure 4:
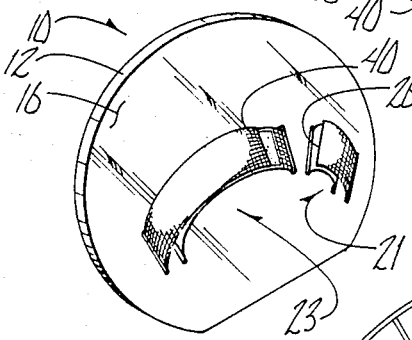
FIG. 4 is a perspective view of the ball catching trainer turned over for use by the user's other hand, and this figure shows the rear hand side.
Figure 5:
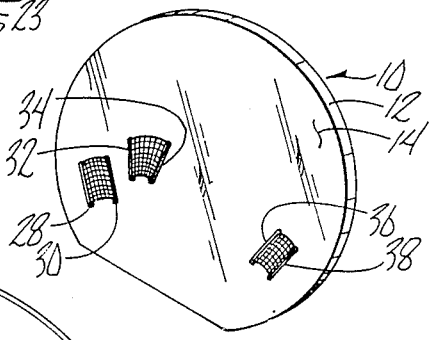
FIG. 5 is a perspective view showing the front-ball side.
Figure 6:
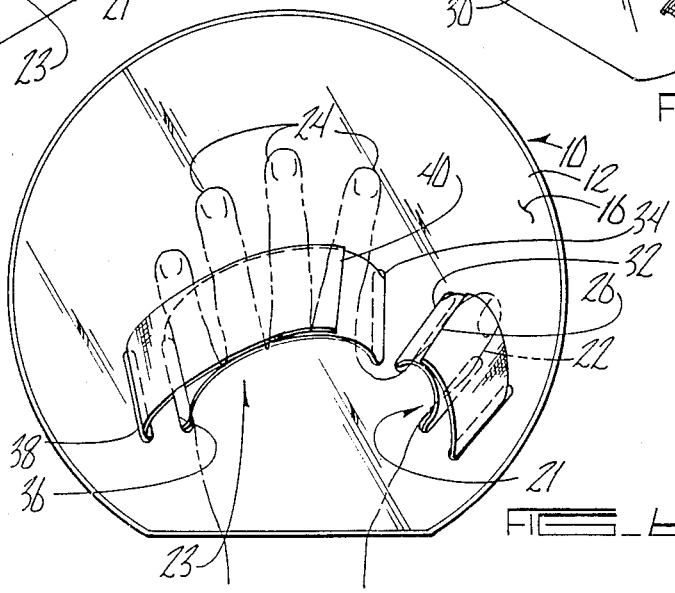
FIG. 6 is a plan view of the rear-hand side with the user's hand in its position of use.
Figure 7:
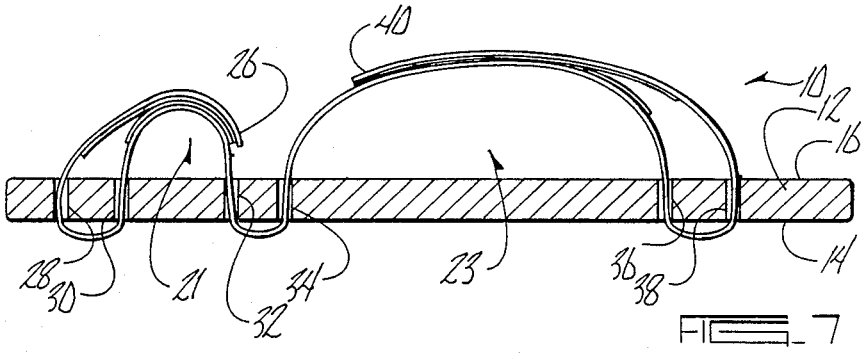
FIG. 7 is a cross-sectional view taken along line 7—7 in FIG. 6.

In FIGS. 4–6, the ball catching trainer 10 has been turned over for use on the user's left hand. Thus, it is seen that what was once the front-ball side 14 is now the rear-hand side 16 and conversely, what was once the rear side 16 is now the front-ball side 14. Like reference numerals are used for identical components whether used on the right or left hands.

Thus, it is seen that the ball catching trainer of this invention may be mass manufactured for use by right or left handed ball players through utilization of a common body member and single strap. The strap is woven through the openings in the body member in an appropriate manner to provide for right or left hand usage.

It is seen that the stress on the strap 20 has been distributed as the connection between the strap and the body member is distributed over three areas on the front-ball side of the body member 14. Should the strap 20 ever wear out, it can be easily replaced by a new strap being threaded by the user through the openings. No special equipment is required to attach the strap to the body member.

What is claimed is:

1. A ball catcher trainer comprising, a body member having a front ball-side and a rear-hand side, said body member having openings extending through said body member between the front and rear sides, a hand strap means on said rear side extending through said openings to hold said strap to said body member and to form finger pockets on said back side adapted to receive a user's fingers for holding said body member on the user's one hand, said finger pockets including one pocket for the user's thumb and one pocket for the other four fingers, said strap means being woven through said openings back and fourth between the front and rear sides to form said thumb and four finger pockets, and said strap including one end on said rear side of said body member with the strap extending through a first opening to the front side and returning through a second opening to the rear side and then extending through a third opening to the front side and forming said thumb pocket on the rear side between said second and third openings, and then back through a fourth opening to the rear side to form said four-finger pocket by extending back to the front side through a fifth opening, and then lastly extending through a sixth opening to the rear side where said other end is adapted to be secured to said four-finger pocket, and said one end is adapted to be secured to said thumb pocket.

2. A ball catcher trainer comprising, a body member having a front ball-side and a rear-hand side, said body member having openings extending through said body member between the front and rear sides, a hand strap means on said rear side extending through said openings to hold said strap to said body member and to form finger pockets on said back side adapted to receive a user's fingers for holding said body member on the user's one hand, said finger pockets including first and second pockets, said strap means being woven through said openings back and forth between the front and rear sides to form said first and second pockets, and said strap including one end on said rear side of said body member with the strap extending through a first opening to the front side and returning through a second opening to the rear side and then extending through a third opening to the front side and forming said first pocket on the rear side between said second and third openings, and then back through a fourth opening to the rear side to form said second pocket by extending back to the front side through a fifth opening, and then lastly extending through a sixth opening to the rear side where said other end is adapted to be secured to said second pocket, and said one end is adapted to be secured to said first pocket.

* * * * *